United States Patent [19]

Farris

[11] 3,999,618

[45] Dec. 28, 1976

[54] HAMMER STABILIZER

[75] Inventor: Ross B. Farris, Midland, Tex.

[73] Assignee: Smith International, Inc., Midland, Tex.

[22] Filed: Jan. 22, 1975

[21] Appl. No.: 542,945

[52] U.S. Cl. ..... 175/92; 175/321; 175/325; 308/4 A

[51] Int. Cl.[2] ..... E21B 17/10

[58] Field of Search ..... 166/241; 175/325, 323, 175/408, 320, 215, 92, 97, 101, 76, 67, 321; 308/4 A

[56] References Cited

UNITED STATES PATENTS

| | | | |
|---|---|---|---|
| 1,620,173 | 3/1927 | Taylor | 166/241 X |
| 1,852,844 | 4/1932 | Greve | 308/4 A X |
| 2,359,717 | 10/1944 | Myers | 175/325 X |
| 2,815,930 | 12/1957 | Storm | 175/325 |
| 2,825,534 | 3/1958 | Reid | 175/323 X |
| 3,123,159 | 3/1964 | Buck | 175/67 |
| 3,151,690 | 10/1964 | Grable | 175/215 X |
| 3,642,079 | 2/1972 | Van Note | 175/325 |
| 3,674,100 | 7/1972 | Becker | 175/325 X |
| 3,820,611 | 6/1974 | King | 175/325 X |
| R26,120 | 12/1966 | Kellner | 175/325 X |

*Primary Examiner*—Ernest R. Purser
*Assistant Examiner*—William F. Pate, III
*Attorney, Agent, or Firm*—Murray Robinson

[57] ABSTRACT

A sub is screwed to the top of a down hole percussor. A replaceable stabilizer sleeve is screwed to the sub and extends down around the percussor body spaced radially therefrom. A rubber shock ring inside the lower end of the sleeve centralizes the sleeve relative to the percussor body.

27 Claims, 4 Drawing Figures

HAMMER STABILIZER

CROSS REFERENCE TO RELATED APPLICATION

A comtemoraneously filed application by WALLACE F. OLSON and J. C. McNeal, Ser. No. 544,069, filed Jan. 27, 1975, assigned to the same assignee as the present application is entitled Bit-Adjacent Stabilizer and Drill Steel.

BACKGROUND OF THE INVENTION

This invention relates to stabilizers used in drilling with down hole percussors.

It is known to provide a stabilizer comprising a tubular mandrel for insertion in a drill string and a sleeve having radially extending wall engaging blades, the sleeve being releasably secured to the mandrel for easy replacement when worn. See for example U.S. Pat. No. 3,754,609 to Garrett and the references therein discussed.

It is known to provide positioning means around down hole motors of various types. See for example United States patent application Ser. No. 419,106 filed Nov. 26, 1973 by Kellner and the continuation thereof Ser. No. 505,450 filed Sept. 13, 1974 and the continuation-in-part thereof being filed approximately contemporaneously herewith and the prior art discussed therein, e.g. U.S. Pat. Nos. 3,561,549 to Garrison et al, 2,637,527 — Andrews, Jr., and 3,399,738 to Haspert.

SUMMARY OF THE INVENTION

In accordance with the invention a sub is screwed to the top of a down hole percussor. A replaceable stabilizer sleeve is screwed to the sub and extends down around the percussor body spaced radially therefrom. A rubber shock ring inside the lower end of the sleeve centralizes the sleeve relative to the percussor body.

BRIEF DESCRIPTION OF THE DRAWINGS

For a detailed description of a preferred embodiment of the invention reference will now be made to the accompanying drawings wherein.

The drawings are to scale. The parts are cross hatched to indicate materials, all parts being steel except as otherwise noted.

DESCRIPTION OF THE PREFERRED EMBODIMENT

Figure 1:
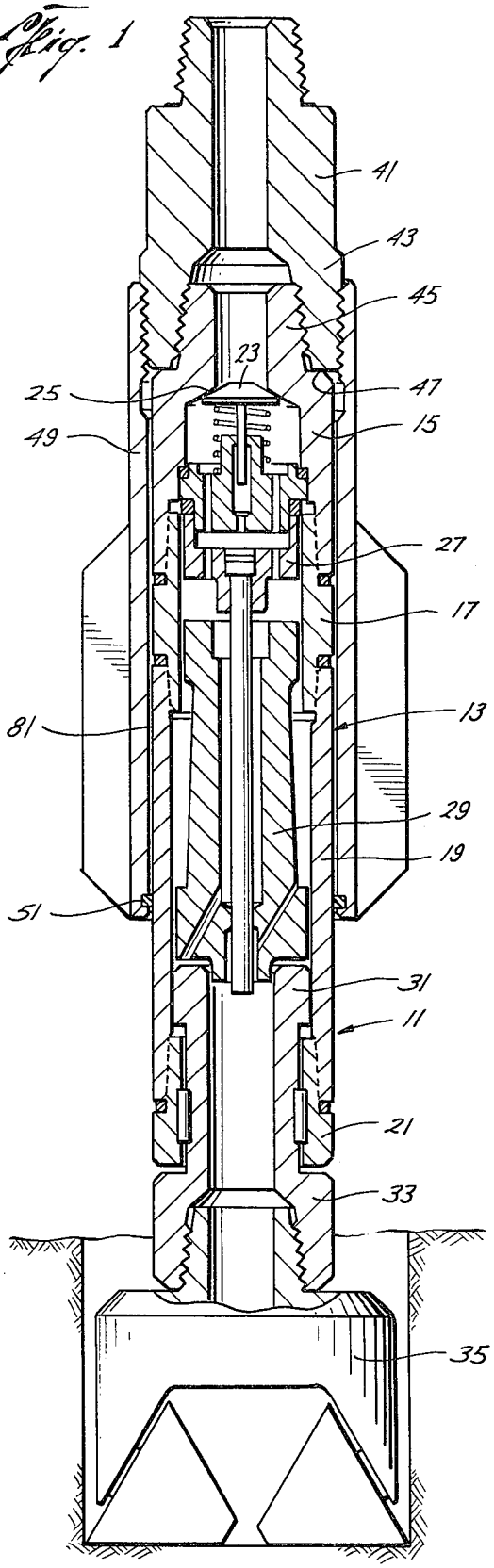
FIG. 1 is an elevation, partly in section, showing a down hole assembly comprising a bit, down hole percussor, sub, and replaceable stabilizer sleeve in accordance with the invention.

Referring now to FIG. 1 there is shown a down-hole percussor 11 including a tubular generally cylindrical body 13. Body 13 includes a check valve housing 15, a double pin connector 17, a hammer barrel 19, and a split retention ring 21. Within the body 13 are a valve dart 23 engageable with a downwardly facing seat 25 in the check valve housing 15, a hammer valve 27 in connector 17, a hammer 29 in barrel 29, and an anvil 31. The lower end of the anvil extends down out of the barrel and is provided with a box 33 into which drill bit 35 is screwed. Ring 21 retains the hammer and anvil in the barrel 19. For a further description of the down hole percussor see page 3069 of the 1972–73 edition of the Composite Catalogue of Oil Field Equipment and Services wherein is described the Mission series 350 Hammerdril. However any form of down hole percussor may be employed in the present invention.

Figure 2:
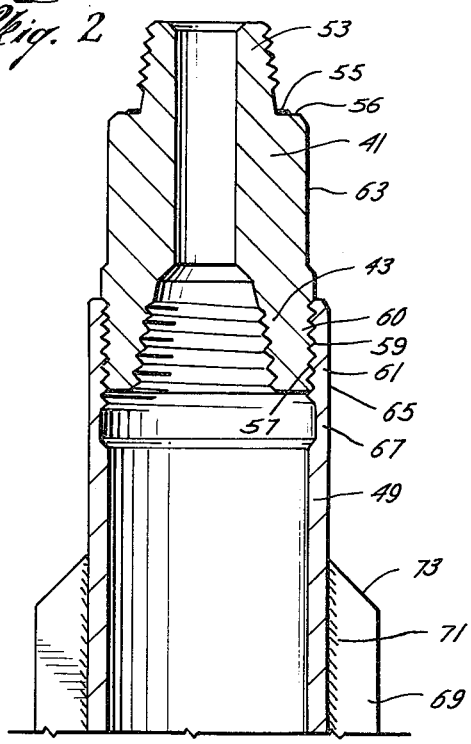
FIGS. 2 and 3 are axial sections showin respectively, to a larger scale, the sub and top part of the sleeve and the lower part of the stabilizer sleeve shown in FIG. 1.
Figure 3:
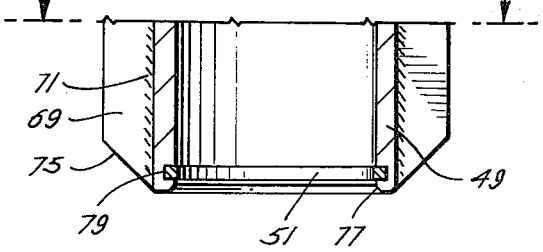
Figure 4:
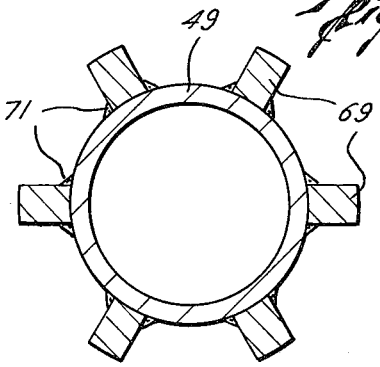
FIG. 4 is a section taken at plane 4—4 of FIG. 3, the shock ring being omitted.

Still referring to FIG. 1, and also to FIGS. 2–4, the assembly according to the invention further includes tubular sub 41 having a threaded box 43 at its lower end for making a rotary shouldered connection with the threaded pin 45 and seal shoulder 47 at the upper end of the percussor body 13. The mouth of the box 43 provides a square shoulder for sealing with shoulder 47 on the percussor. A stabilizer sleeve or skirt 49 is screwed to the exterior of sub 41 and extends down around the exterior of percussor body 13, being radially spaced from the body a slight amount, e.g. of the order of at least 1/32 inch (0.8 mm.). The lower end of the sleeve skirt terminates sufficiently above the lower end of barrel 19 to leave room for a wrench as required for making up the assembly as will be described later, for example an axial extent of about 6 inches (15 cm.) may be left. This also makes it possible to change bit 35 without regard to the stabilizer sleeve skirt.

Inside the lower end of sleeve skirt 49 is secured an elastomer ring 51. This ring is under radial compression between barrel 19 and skirt 49 when the skirt is assembled on the barrel, a radial compression of ⅛ inch, e.g. (30 mm) being effected by such assembly. This ring serves to centralize the sleeve skirt on the percussor 11 while absorbing some of the shock that might otherwise be transmitted between the barrel and skirt. A durometer hardness of about 70 is appropriate, a range of 60 to 80 being suitable, although the hardness range has no critical cut off limits.

Referring now particularly to FIG. 2, the upper end of stabilizer sub 41 is provided with a tool joint connector for making a rotary shouldered connection with the lower end of a joint of drill pipe. The connection may be either a pin or box as desired, a threaded pin 53 and seal shoulder 55 being shown. A relieved area 56 extends around shoulder 55.

The exterior of box 43 on the stabilizer sub is taper threaded at 57, providing a threaded pin 60 to which the sleeve skirt 49 is screwed. The pin tapers in a direction to flare upwardly. The sleeve skirt 49 is internally taper threaded at 59, providing a threaded box 61 which screws onto the sub pin 60. If desired a rotary shouldered connection could be used for pin 60 and box 61 but the simple taper threaded connection seems to be adequate. If the sleeve skirt should come unscrewed, it would be retained by the drill bit 35 so as not to junk the hole being drilled.

Smooth cylindrical areas 63, 65 on the sub 41 and box 61 provide room for application of wrenches as needed for making a breaking the connection therebetween. Other, non-circular, wrench configurations can be applied to these surfaces if desired.

Between box 61 and the remainder of skirt 49 is a thin wall section 67 providing stress relief and flexibility.

Referring now to FIGS. 2, 3, and 4, to the exterior of skirt 49 are welded a plurality of radially extending blades 69, the welds being indicated at 71. The inner and outer peripheries of these blades are shown to be cylindrical, conforming in radius respectively to the exterior of skirt 49 and the interior of the hole being bored by bit 35. Any suitable form of hard facing may be applied to the blades if desired, for example as shown in the aforementioned companion application cross referenced above. The blades 69 are bevelled at their upper and lower ends as shown at 73, 75.

The interior lower edge of skirt 49 is bevelled at 77 to facilitate assembly with the percussor 11. Just above the lower end of skirt 49 there is an internal groove 79 within which is disposed elastomer ring 51. The square configuration of the groove cross section and the ring cross section retains the ring in the groove. However any other suitable retention means can be used; especially if a softer ring is employed. The ring not only serves as a centralizer for the stabilizer and as a shock absorber, but also provider means to seal between the skirt and barrel to keep dirt, detritus, and other foreign matter out of the annular space 81 therebetween (see FIG. 1).

Whenever the stabilizer skirt becomes worn out, it can be easily replaced by unscrewing it from the sub 41 and substituting another skirt.

Summarizing, the apparatus according to the invention includes:

1. Top Sub has pin and box connection same as hammer connection. O.D. of sub has a male threaded connection down. Wrenching configurations may be added to O.D. of sub as required.
2. Sleeve has a box threaded connection up to mate with the O.D. threaded connection on the top sub. Lower end of sleeve has a rubber shock ring for centralizing the sleeve concentric to the O.D. of the hammer body. The ribs may be spiral or straight and the length and number of ribs are relative to the hole size. There is a built-on clearance between the body O.D. and the sleeve I.D. to eliminate metal to metal contact.
3. Hole size is relative to hole size range of the hammer in use.

The apparatus is assembled as follows:

1. Top sub is screwed onto the top connection of the hammer and then this assembly is screwed to the drill string.
2. The hammer body is then slipped down through the sleeve and the sleeve screwed onto the top sub.
3. The bit and anvil is then screwed into the hammer body.

The general concept of the invention is that stabilization is placed as near the bit as practical, to minimize hole deviation in drilling a straight hole for Water Well, Blast Hole and Construction Holes in any direction.

Features of the Invention include:

1. Near bit stabilization for drilling straight holes.
2. Eliminate wear on O.D. of hammer body.
3. Increase bottom hole cleaning by reducing hole annulus.
4. Replaceable sleeves, hammer does not have to be removed from string.
5. Straight ribs, spiral ribs with tungsten carbide hardfacing or buttoms.
6. Conditions hole wall.
7. Reduces noise level.

While a preferred embodiment of the invention has been shown and described, many modifications thereof can be made by one skilled in the art without departing from the spirit of the invention.

I claim:

1. Drilling assembly comprising a percussor having attachment means at one end for making connection with a drill bit and connection means at its other end for making connection with another drill stem member, a tubular sub having connection means at one end correlative to the connection means at said other end of the percussor and connected thereto, said sub having securement means at its other end for making connection with another drill stem member, said sub having releasable means at said one end for making connection with a skirt, and a tubular skirt disposed around said percussor, said skirt having releasable means at one end correlative to said releasable means on the sub and connected thereto, said skirt having wall contacting means on its outer periphery for contacting the side of a hole being bored.

2. Assembly according to claim 1 wherein the other end of said skirt is spaced axially from said one end of the percussor far enough to leave room for application of wrenching means to said percussor, e.g. an axial distance on the order of the outer diameter of the percussor.

3. Assembly according to claim 2 wherein said skirt is radially spaced from said percussor and including annularly disposed means between said skirt and percussor centralizing said skirt on said percussor.

4. Assembly according to claim 3 wherein said annularly disposed means is made of elastomeric material and provides a shock absorber between the skirt and percussor.

5. Assembly according to claim 4 wherein said annularly disposed means is a ring extending continuously around the interior of the skirt near the other end thereof providing a seal between said skirt and percussor.

6. Assembly according to claim 5 wherein said ring is in compression.

7. Assembly according to claim 6 wherein said ring is rubber having a durometer hardness of between 60 and 80.

8. Assembly according to claim 7 wherein said ring has a rectangular cross section and said skirt has a rectangular cross section groove therein into which fits said ring.

9. Assembly according to claim 8 wherein said releasable means on the sub and skirt comprise tapered threads.

10. Assembly according to claim 9 wherein the skirt is provided with an internal groove between said threads and the rest of the skirt for stress relief and flexibility.

11. Assembly according to claim 10 wherein said connection means on the sub and percussor comprise a taper threaded pin and seal shoulder on the percussor and a correlative taper threaded box and seal shoulder on the sub forming together a rotary shouldered connection.

12. Assembly according to claim 11 wherein said securement means on the sub is a taper threaded pin with a seal shoulder therearound.

13. Assembly according to claim 12 wherein there is a relieved area adjacent to the outer periphery of said seal shoulder of said securement means.

14. Assembly according to claim 13 wherein said wall contacting means comprises a plurality of blades extending radially from said skirt.

15. Assembly according to claim 14 including a drill bit connected to said attachment means on said one end of the percussor, said wall contacting means having a maximum radial extent from the axis of the assembly substantially equal to that of said bit.

16. Stabilizer assembly for a downhole percussor comprising a tubular sub having connection means at one end for making connection with a downhole percussor and having securement means at its other end for making connection with another drill stem member, said sub having releasable means at said one end for making connection with a skirt, and a tubular skirt adapted to be disposed around such percussor, said skirt having releasable means at one end correlative to said releasable means on the sub and connected thereto, said skirt having wall contacting means on its outer periphery for contacting the side of a hole being bored.

17. Assembly according to claim 16 including annularly disposed means on the interior of the skirt for centralizing the skirt about the percussor.

18. Assembly according to claim 17 wherein said annularly disposed means is made of elastomer material to provide a shock absorber between the skirt and percussor.

19. Assembly according to claim 18 wherein said annularly disposed means is a ring extending continuously around the interior of the skirt near the other end of the skirt to provide a seal between the skirt and a percussor.

20. Assembly according to claim 19 wherein said ring is rubber having a durometer hardness of between 60 and 80.

21. Assembly according to claim 20 wherein said ring has a rectangular cross section and said skirt has a rectangular cross section groove therein into which fits said ring.

22. Assembly according to claim 21 wherein said releasable means on the sub and skirt comprise tapered threads.

23. Assembly according to claim 22 wherein the skirt is provided with an internal groove between said threads and the cut of the skirt for stress relief and flexibility.

24. Assembly according to claim 23 wherein said connection means on the sub is a taper threaded box and a seal shoulder adapted to make a rotary shouldered connection with a correlative pin on a percussor.

25. Assembly according to claim 24 wherein said securement means on the sub is a taper threaded pin with a seal shoulder therearound.

26. Assembly according to claim 25 wherein there is a relieved area adjacent to the outer periphery of said seal shoulder of said securement means.

27. Assembly according to claim 26 wherein said wall contacting means comprises a plurality of blades extending radially from said skirt.

* * * * *

UNITED STATES PATENT AND TRADEMARK OFFICE

CERTIFICATE OF CORRECTION

PATENT NO. : 3,999,618

DATED : DECEMBER 28, 1976

INVENTOR(S) : ROSS B. FARRIS

It is certified that error appears in the above-identified patent and that said Letters Patent are hereby corrected as shown below:

Column 1, line 66, change "29" (second occurrence) to -- 19 --.

Column 2, line 57, change "a" to -- and --.

Column 5, line 22, change "the" to -- a --.

Column 3, line 60, change "buttoms" to -- buttons --.

Signed and Sealed this

Fifth Day of April 1977

[SEAL]

*Attest:*

RUTH C. MASON
*Attesting Officer*

C. MARSHALL DANN
*Commissioner of Patents and Trademarks*